United States Patent [19]

Ramsley

[11] 4,329,966

[45] May 18, 1982

[54] CONTROLLED POLLUTION CONTROL VALVE BY-PASS DEVICE FOR CARBURETED INTERNAL COMBUSTION ENGINE

[76] Inventor: Dean E. Ramsley, Box 73, Viborg, S. Dak. 57070

[21] Appl. No.: 157,986

[22] Filed: Jun. 9, 1980

[51] Int. Cl.[3] ..... F02M 25/06

[52] U.S. Cl. ..... 123/572; 123/574

[58] Field of Search ..... 123/572, 574, 41.86, 123/DIG. 11

[56] References Cited

U.S. PATENT DOCUMENTS 2,818,052 12/1957 Trainer ..... 123/572

2,906,252 9/1959 Beardsley ..... 123/572

3,123,060 3/1964 Daigh ..... 123/572

3,241,535 3/1966 Drysdale ..... 123/572

FOREIGN PATENT DOCUMENTS 2112280 9/1972 Fed. Rep. of Germany ..... 123/572

*Primary Examiner*—Ronald H. Lazarus

[57] ABSTRACT

A fuel saving device for a carbureted engine having a pollution control valve comprising a by-pass duct adapted to convey gases from the crankcase around the pollution control valve directly to the carburetor and a valve in the duct controlled by the manifold vacuum to open the valve at lower pressure in the manifold and close it at less depressed pressures.

4 Claims, 3 Drawing Figures

CONTROLLED POLLUTION CONTROL VALVE BY-PASS DEVICE FOR CARBURETED INTERNAL COMBUSTION ENGINE

BACKGROUND AND SUMMARY OF THE INVENTION

This invention pertains to devices adapted to increase fuel efficiency in a carbureted engine, and more specifically to a device adapted to by-pass the pollution control valve (PCV) now required of a normal automobile engine and thereby to increase the flow of gases from the crankcase of the engine to the engine intake system downstream of the mixing area in the carburetor.

The current requirements of the use of emission controls on automobile engines has resulted in a reduction in fuel efficiency on such engines. The high cost of gasoline to be used in such engines has made maximum fuel efficiency desirable. The emission control commonly in use is the PCV system which injects gaseous material from the crankcase of the engine into the intake system of the engine at a point just downstream of the carburetor. The valve called the PCV simply controls the amount of flow.

Many devices have been proposed to inject additional fresh air into the PCV line entering the intake system. Some have been hand controlled, other electrically controlled.

My device is somewhat similar to the fresh air injection devices, although it provides better efficiency. Instead of introducing fresh air and still using the PCV with the high pressure drop across the valve, I provide a by-pass system allowing substantially higher flow from the crankcase at times when the intake manifold vacuum is highest (lowest pressure). I do this by means described hereafter and illustrated in the following figures.

FIGURES

DESCRIPTION

Figure 1:
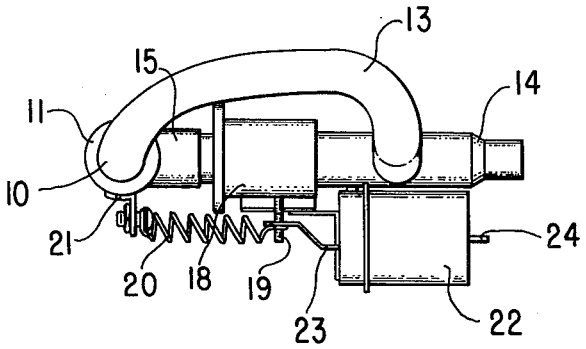
FIG. 1 is a top plan view of my device.
Figure 2:
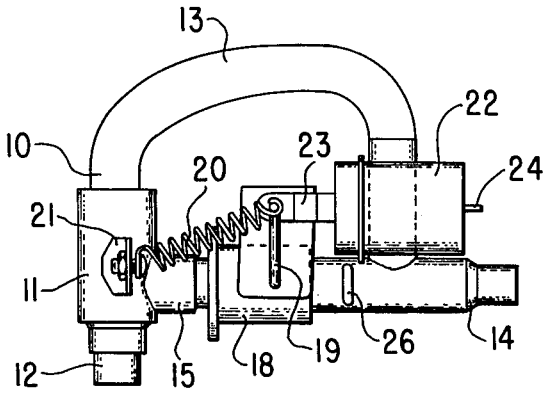
FIG. 2 is a side elevational view of my device.

Briefly my invention is a by-pass means for the PCV line in a carbureted engine having control means in the by-pass by which the PCV is by-passed only when the manifold vacuum is greatest.

More specifically, and referring to the drawings, I build my device in conjunction with the conventional PCV 10 adapted to open into the crankcase of an automobile engine. Instead of having the valve directly connected to the crankcase, I provide a "T" fitting 11 in the line. One end 12 of the "T" is adapted to be connected to the customary PCV outlet from the crankcase (not shown).

The outlet from the PCV is, in my device, a tube 13 connected to a pipe 14 or the like which provides the connection to the engine intake system downstream of the carburetor as is well known in the art.

By using the "T" 11, I can by-pass the PCV 10 and duct the gases entering the end 12 of the "T" through the leg 15 and through the pipe 14 directly into the intake system. Such direct connection is not satisfactory, because it completely negates the effect of the PCV. However, I have discovered that the principal inefficiencies caused by the PCV occur when the greatest vacuum exists in the intake manifold. Therefore, I provide a butterfly valve 17 enclosed in a body 18 inserted into the by-pass line.

Figure 3:
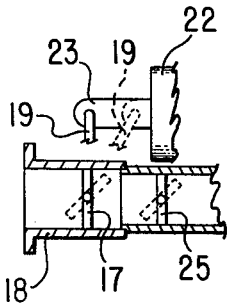
FIG. 3 is a detailed view showing the two positions of the valve of my device and its operating lever.

The valve 17 is controlled from the exterior by a lever 19 which can work back and forth as illustrated in the two positions shown in FIG. 3. The valve is biassed to a normally closed position by means of a tension spring 20 engaged between the lever 19 and a bracket 21 which may be fixed to the body of the "T" fitting 11. Movement of the lever is controlled by a vacuum cylinder device 22 including an operating member 23 attached to the lever 19.

The cylinder device 22 is of the type in which the member 23 is drawn into the cylinder by higher degrees of vacuum in the cylinder. The vacuum in the cylinder is drawn through a tubular inlet 24, which in my device is connected to the same vacuum line that controls the spark advance through the position of the distributor in a manner well known in the art.

Thus when the manifold vaccum is greatest (pressure lowest), the vacuum is drawn in the cylinder 22. This results in the pulling of the member 23 into the cylinder and the opening of the valve 17. Gases from the crankcase can then bypass the PCV and be recycled directly into the intake system. My tests indicate that such by-pass substantially reduces fuel consumption at such times and thus provides real increases in fuel efficiency of the automobile engine so equipped.

In order to provide for more flexibility I may also provide a manually adjustable butterfly valve 25 in the body 18. Although I have illustrated this valve downstream of the valve 17, it is clear that it could be upstream as well. A control handle 26 may be used to control the position of the valve. This type of structure may best be used if the device is to be sold as an attachment for use with various sizes and types of engines to provide for the best setting for each individual engine.

It is also envisioned that a valve such as the valve 25 might be controlled by the temperature of the gas flowing through the body 18 in a manner well known in the art. Such a control might be useful if it were desired that the by-pass only be opened after the engine is warmed up. It is obvious that the heat sensor of any heat controlled valve must be upstream of the butterfly valve 17.

I claim:

1. A device comprising in combination with an internal combustion engine having a crankcase and an intake system including a carburetor; a line from the crankcase of said engine to the intake system below the carburetor, a pollution control valve in said line and a by-pass means in said line adapted to by-pass said pollution control valve, and vacuum controlled valve means in said by-pass means adapted normally to close said by-pass means, said controlled valve being operable to open when the vacuum is greatest in said intake system.

2. The device of claim 1 in which said controlled valve includes a control lever, tension means connected to said control lever to bias it to a normally closed position.

3. The device of claim 2 in which means to move said lever and therefore to control said controlled valve includes a vacuum operated cylinder device connected to said lever whereby said lever will be moved counter to the bias of said tension means to open said valve, said cylinder being connected to said intake system whereby the degree of vacuum in said system controls the position of said lever.

4. The device of claim 3 in which a manually adjustable valve is located in said by-pass means whereby the normal maximum flow may be regulated to adapt to individual engines.

* * * * *